US006036808A

United States Patent [19]

Shaw-Klein et al.

[11] Patent Number: 6,036,808

[45] Date of Patent: Mar. 14, 2000

[54] LOW HEAT TRANSFER MATERIAL

[75] Inventors: Lori J. Shaw-Klein, Rochester; Audry A. Malcolm, West Henrietta; Douglas E. Bugner, Rochester, all of N.Y.

[73] Assignee: Eastman Kodak Company, Rochester, N.Y.

[21] Appl. No.: 08/904,108

[22] Filed: Jul. 31, 1997

[51] Int. Cl.[7] ..... B41M 5/00

[52] U.S. Cl. ..... 156/235; 347/105; 428/195; 428/913; 428/914

[58] Field of Search ..... 428/195, 913, 428/914; 347/105; 156/235

[56] References Cited

U.S. PATENT DOCUMENTS

| | | | |
|---|---|---|---|
| 4,980,224 | 12/1990 | Hare | 428/202 |
| 5,439,739 | 8/1995 | Furukawa et al. | 428/341 |
| 5,488,907 | 2/1996 | Xu et al. | 101/488 |
| 5,501,902 | 3/1996 | Kronzer | 428/323 |
| 5,522,317 | 6/1996 | Hale et al. | 101/488 |
| 5,622,808 | 4/1997 | Bowman et al. | 430/199 |

OTHER PUBLICATIONS

Research Disclosure Item No. 308119, vol., 308, Dec. 1989, pp. 1007–1008 and 1005–1006.

*Primary Examiner*—Bruce H. Hess
*Attorney, Agent, or Firm*—Doreen M. Wells

[57] ABSTRACT

An ink receptive element for transferring images to fabric at a temperature between 170° C. and 100° C. A method of transfer is also disclosed.

12 Claims, No Drawings

LOW HEAT TRANSFER MATERIAL

FIELD OF THE INVENTION

This invention relates to an ink receptive material which is suitable for inkjet printing and is useful as a heat transfer material.

BACKGROUND OF THE INVENTION

Transfer of images to fabric is of interest to consumers wishing to personalize clothing, mouse pads, decorative items et cetera. While methods for transferring graphical illustrations and photographic images are well described in the art, many of these means are not suitable for home use. For example, fabric may be printed directly using inkjet printers containing inks which comprise dyes capable of reacting with fabric fibers, but these methods are limited in that complex shapes such as t-shirts and the like are difficult or impossible to feed through an inkjet printer designed for home use.

Therefore, methods have been developed which make use of transfer inks or transfer media. For example, an ink containing a dye which is mobile when heated (preferably ironed) can be loaded into an inkjet printer (U.S. Pat. No. 5,488,907 to Sawgrass Systems) or used to make transfer ribbons in a thermal printer (U.S. Pat. No. 5,522,317 to Sawgrass Systems). The image of interest is printed on, for example, clay-coated paper. The coated paper is held in contact with the fabric which is to receive the image and with thermal activation (ironing or a heat press) the dyes are transported into the fabric. Such a method is limited, however, to relatively expensive thermal printers not typically found in homes, or to specific inkjet printers in which ink is ejected by piezoelectric pulses. Such a heat activated ink cannot be successfully employed in the more ubiquitous thermal inkjet printers in which ink must be heated in order to be ejected. In addition, these methods result in reduced optical density of the images since the dye is never fully transferred to the fabric, and the dye that is transferred sinks into the fabric. Furthermore, for the dyes to sublime, temperatures in excess of the softening point of preferred fabrics such as polyester and nylon are exceeded. Constraints on allowable dwell time at the subliming temperature require the consumer to exercise caution so that the fabric is not damaged.

Methods in which the entire printed image (inks or dyes and the ink or dye receptive layer) are transferred to fabric have also been developed for inkjet printers. Such methods have the advantage that many of the commercially available inkjet printers may be used to generate the image. However, some obstacles still exist in perfecting this transfer method. In U.S. Pat. No. 4,980,224 to Foto-Wear, Inc., an ink receptive coating comprising Singapore Dammar resin mixed with abrasive particle is described. A natural resin such as Singapore Dammar resin does not exhibit high swellability in aqueous inks like those used in home inkjet printers. As a result, such a coating will not function as an efficient inkjet receptive layer for the high ink laydowns required for high quality graphic or photographic images. Coalescence or pooling of the ink may occur before the image has a chance to completely dry, causing poor image quality. Further, such a receptive layer requires a heat press rather than an iron for best transfer results, which is not typically available in the home. An attempt is made to address such concerns in U.S. Pat. No. 5,501,902 to Kimberly Clark. In this case, the ink receptive element is designed so that it can be efficiently transferred by conventional ironing. However, it too comprises hydrophobic particulate species. As a result, high quality images with heavy ink laydowns often exhibit unacceptable bleed when printed on such materials. Moreover, such an inkjet printable material also requires high (about 170° C.) temperatures for effective transfer to fabric, causing the same concerns for fabric damage described above. Moreover, the preferred embodiments of such a transfer material involve deposition of several layers of ink absorbing materials, raising the manufacturing cost and complexity of producing such items.

SUMMARY OF THE INVENTION

An ink receptive element which records high quality graphic and photographic images capable of being transferred to fabric at temperatures as low as 100° C. has been developed. The invention comprises a support material with release properties and an ink receptive element comprising a hydrophilic film-forming binder. Optional additives include crosslinkers, mordants and mechanical-property modifying hard or soft fillers.

The present invention provides an ink receptive element capable of heat transferring images to fabric at a temperature between 170° C. and 100° C.

In another aspect of the invention, there is disclosed A method of transferring an image to fabric comprising the steps of: imagewise transferring an ink composition to an ink receptive element; and imagewise transferring the ink from the receptive element to fabric at a temperature above the lowest Tg of the materials in the ink receptive element.

One advantage of the present invention is that the claimed heat transfer material has improved ink absorption characteristics such that photographic and other images can be more sharply rendered. Another advantage is that the image can be transferred to the object on which it is to appear at a lower temperature than was previously possible.

DETAILED DESCRIPTION OF THE INVENTION

In general, an ink is used to record an image on an ink receptive element containing a hydrophilic film-forming binder. The element is subsequently heated to transfer the image to an object or fabric which is to receive the image. The hydrophilic film-forming binder is about 10 to 100 weight percent, and preferably 15 to 50 weight percent of the ink receptive composition. The temperature at which the image is transferred to the final object or fabric is about 170° C. to 100° C., preferably 125° C. to 110° C., and most preferably 120° C. to 100° C. The temperature will vary depending on the materials used in the ink receptive layer or in the fabric receiving the final image since, for transfer of the image to occur, the temperature must exceed the lowest Tg of the components in the ink receptive layer or in the fabric.

As used herein, the term "fabric" describes any material, natural or man-made, which can receive an image. "Fabric" includes textiles, leather, rubber, thermoplastics, polymeric materials and the like As used herein, the terms "ink receptive element", "ink receptive layer" and "heat transfer material" describe a medium which receives ink and later transfers the ink to an object on which an image is to appear. The object is usually made of fabric.

In particular, the ink receptive element of the invention comprises a hydrophilic film-forming material coated on a support from which it can be easily removed. Examples of such support materials include polyethylene therephthalate, polyethylene naphthalate, poly-1,4-cyclohexane dimethylene terephthalate, polyvinyl chloride, polyimide, polycarbonate, polystyrene, cellulose acetate, cellulose acetate propionate, cellulose acetate butyrate, paper with extruded protective layers such as polyethylene or polypropylene, or any continuous web material subsequently coated with a well-known release layer such as cellulose ethers or polyethylene.

Examples of hydrophilic materials which form excellent ink-receptive elements for aqueous inks include but are not limited to polyvinyl alcohols and their derivatives, polyvinyl pyrrolidone, sulfonated or phosphated polyesters, cellulose ethers and their derivatives, poly(2-ethyl-2-oxazoline), gelatin, casein, zein, albumin, chitin, chitosan, dextran, pectin, collagen derivatives, collodian, agar-agar, arrowroot, guar, carrageenan, tragacanth, xanthan, rhamsan, sulfonated polystyrenes, acrylamides and their derivatives, polyalkylene oxides and the like. A combination of such materials may be used and in fact may be preferred in order to obtain phase separation or some other effect associated with the non-glossy images preferred for fabric transfers.

The hydrophilic film forming binder may also include a crosslinker. Such an additive improves the adhesion of the ink receptive element to the fabric as well as contributes to the cohesive strength of the layer. Crosslinkers such as carbodiimides, polyfunctional aziridines, melamine formaldehydes, isocyanates, epoxides, polyvalent metal cations, and the like may all be considered.

In addition, the film forming binder may also include a particulate or interpenetrating network filler in order to confer more flexibility to the layer and even greater adhesiveness to the fabric. In particular, elastomeric aqueous dispersible polymers such as styrene butadiene or styrene acrylonitrile butadiene rubbers or especially polyurethanes are preferred filler additives to improve the flexibility and appearance of such ink receptive layers. Preferably, the polyurethane is an aliphatic polyurethane. Aliphatic polyurethanes are preferred for their excellent thermal and UV stability and freedom from yellowing. While useful polyurethanes may be anionic in nature, in the presence of cationic mordants a cationic or nonionic polyurethane is preferred for formulation stability. Preparation of aqueous polyurethane dispersions is well known in the art. Thorough descriptions are given in Progress in Organic Coatings, volume 9, pp. 281–340 (Elsevier, 1981).

If greater abrasion resistance is required, an inorganic particulate filler such as colloidal silica, alumina or the like may be added. While colloidal silica is preferred from a cost standpoint, its basic nature can cause instability in formulations containing cationic species such as dye mordants, so a colloidal aluminum modified silica (such as Ludox CL™ (DuPont); or Snowtex™ O-UP, (Mitsubishi Chemicals) may be added.

Colloidal alumina in the form of boehmite is also a popular additive in inkjet recording layers and may be added to formulations such as those described here, without adverse effects.

Waterfastness can be imparted to the ink receptive element through appropriate selection and addition of dye mordants. For example, if the dyes are primarily anionic (as are typical in commercially available desktop inkjet printers), quaternary ammonium or phosphonium containing polymers, surfactants, etc., may be added. Alternately, other mordanting materials well known in the art may be selected, such as amine containing polymers or simply a polymer or species carrying positive charges. Conversely, if the printing dyes are anticipated to be cationic, anionic mordants may be selected. Finally, if the inks contain pigmented colorants rather than dyes, mordants are not necessary to impart waterfastness.

The thickness of the ink receptive element should range from about 3 to 20, preferably from 5 to 10 $\mu$m. The coating composition of the invention can be applied by any number of well-known techniques, such as dip-coating, rod-coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, published December 1989, pages 1007 to 1008.

In order to obtain adequate coatability, additives such as surfactants, defoamers, alcohol and the like known to those familiar with the art may be used. A common level for coating aids is 0.01 to 0.30 per cent active coating aid based on the total solution weight. These coating aids can be nonionic, anionic, cationic or amphoteric. Specific examples are described in *Research Disclosure* No.308119, published December 1989, pages 1005 to 1006.

EXAMPLES

In the following examples, ink receptive elements made of the various compositions listed in Table II were coated by slot coating directly onto polyethylene terephthalate 100 $\mu$m. Each composition was coated from 10% solids in deionized water. Olin 10G™ (Dixie Chemicals), a non-ionic surfactant, was added at a level of 0.02 weight % of the coating solution as a coating aid. The coatings were thoroughly dried by forced air heating. Dry thickness of the films was approximately 5 $\mu$m. Printing of photographic images was performed on a Hewlett-Packard 850° C. or 690° C. inkjet printer. Highest available ink laydowns were selected by specifying best quality, photographic printing modes. Photographic images were transferred to fabric by passing through heated rollers held at 120° C. to 130° C. Travel time through the heated rollers was approximately 40 seconds for an 11 inch sheet.

Transfer quality was evaluated by visible inspection as follows:

Excellent: Transferred image had no missing areas or visible defects

Fair: Transferred image had few visible defects or small areas missing

Poor: Transferred image had many objectionable defects and/or did not successfully transfer.

Transfer adhesion was evaluated by moderately scratching with the fingernail and by bending the fabric such that a fold was formed. Evaluation was recorded as follows:

Excellent: Transferred image could not be removed with scratching of the fabric

Fair: Transferred image could be slightly removed with scratching but did not delaminate with bending Poor: Transferred image delaminated with bending or came off easily with scratching Examples 1–5 were printed on a Hewlett-Packard 850C, while Example 6 was printed on a Hewlett-Packard 690C using photo inks.

TABLE I

| Example | Composition | Fabric | Transfer Quality | Transfer Adhesion |
|---|---|---|---|---|
| 1 | A | cotton | Fair | Fair |
| 2 | B | " | Excellent | Poor |
| 3 | C | " | Excellent | Fair |
| 4 | D | " | Poor | Poor |
| 5 | E | " | Excellent | Fair |
| 6 | E | cotton/polyester blend | Excellent | Excellent |

Compositions are as follows, recorded in dry weight per cents:

TABLE II

| Composition | PVA | Mordant | Gelatin | W213 | CDI | BVSM |
|---|---|---|---|---|---|---|
| A | 90 | 10 | — | — | — | — |
| B | 85.5 | 10 | — | — | 4.5 | — |
| C | 25 | 10 | 65 | — | — | — |
| D | 20.5 | 10 | 65 | — | — | 4.5 |
| E | 45 | 10 | — | 45 | — | — |
| F | 18 | 10 | — | 72 | — | — |

PVA: Polyvinyl alcohol, Elvanol ™ 52/22 (DuPont)
Mordant: Crosslinked vinylbenzyl ammonium chloride polymer as described in U.S. Pat. No. 5,622,808
Gelatin: Photographic grade alkali-processed ossein gelatin
W213: Witcobond ™ W-213 polyurethane (Witco)
CDI: Aliphatic carbodiimide, Ucarlink XL-29E ™ (Union Carbide)
BVSM Bis(vinylsulfonyl)methane

EXAMPLES

Composition E was coated on resin coated paper under identical conditions as those described above. A photographic quality image was printed on the sample using a Hewlett Packard 690C with photoinks and allowed to dry. The image was transferred to cotton-polyester fabric using a conventional household iron having a surface temperature of 120° C. (silk-rayon setting). The image quality and adhesion were excellent.

A second composition (F) comprising PVA/W213/mordant in a ratio of 18/72/10 was also coated on resin coated paper and transferred to cotton-polyester fabric using a handheld iron at 120° C. Image quality and adhesiveness were maintained, and the image area on the cloth had a softer feel than the image transferred using composition E.

Comparative Example

A commercially available thermal transfer sheet, sold as Canon T-shirt transfer TR-101, was printed with a photographic image on a Hewlett-Packard 850C inkjet printer and passed through heated rollers as described above in contact with cotton fabric. Inspection of the image showed significant smearing or bleed due to the large amount of ink used to generate such photographic quality images. No transfer occurred because the transfer sheet melted and stuck to the fabric and could not be separated. Much higher temperatures were required in order to successfully transfer and separate such an image using these transfer sheets.

These examples illustrate the clear advantage of the present invention over currently available ink receiving elements designed for the same purpose.

The invention has been described in detail with particular reference to certain preferred embodiments thereof, but it will be understood that variations and modifications can be effected within the spirit and scope of the invention.

What is claimed is:

1. An ink receptive element comprising a support having release properties and an ink receptive coating that contains a hydrophilic film-forming binder and a crosslinker, said element being capable of heat transferring images to fabric at a temperature between 170° C. and 100° C.

2. The ink receptive element of claim 1 capable of heat transferring images to fabric at a temperature between 125° C. to 110° C.

3. The ink receptive element of claim 1 capable of heat transferring images to fabric at a temperature between 120° C. to 100° C.

4. The ink receptive element of claim 1 wherein the binder is 100 to 10 weight percent of the coating.

5. The ink receptive element of claim 1 wherein the binder is 50 to 15 weight percent of the coating.

6. The ink receptive element of claim 1 wherein the coating is an ink.

7. The ink receptive element of claim 1 wherein the coating comprising a hydrophilic film-forming binder is 3 to 20 $\mu$m thick when dried.

8. The ink receptive element of claim 1 wherein the coating comprising a hydrophilic film-forming binder is 5 to 10 $\mu$m thick when dried.

9. The ink receptive element of claim 1 wherein the coating further comprises a filler.

10. The ink receptive element of claim 1 wherein the coating further comprises colloidal alumina.

11. A method of transferring an image to fabric comprising the steps of:

imagewise transferring an ink composition to an ink receptive element of claim 1; and imagewise transferring the ink from the receptive element to fabric at a temperature above the lowest Tg of the materials in the ink receptive element.

12. The method of claim 11 wherein the temperature during transfer is between 170° C. and 100° C.

* * * * *